US005323819A

United States Patent [19]

Shade

[11] Patent Number: 5,323,819

[45] Date of Patent: Jun. 28, 1994

[54] OVERHEAD VACUUM ASSEMBLY FOR RECOVERING, STORING AND DISPENSING FLOWABLE PACKAGING MATERIALS

[76] Inventor: Charles L. Shade, 430 Encinal Canyon Rd., Malibu, Calif. 90265

[21] Appl. No.: 1,457

[22] Filed: Jan. 7, 1993

[51] Int. Cl.[5] ..... B65B 1/16

[52] U.S. Cl. ..... 141/65; 141/45; 141/46; 141/67; 141/18; 141/93; 141/286; 141/390; 141/316; 222/105; 222/181; 406/152; 406/171

[58] Field of Search ..... 141/2, 7, 10, 18, 21, 141/45, 46, 59, 65, 67, 68, 98, 93, 114, 286, 311 R, 313–317, 382, 390, 44; 406/151, 152, 171; 383/12, 22, 41; 220/9.1, 401; 222/105, 106, 109–111, 152, 181, 183

[56] References Cited

U.S. PATENT DOCUMENTS

| | | | |
|---|---|---|---|
| 1,027,570 | 5/1912 | Sheldon . | |
| 1,037,824 | 9/1912 | Fasting . | |
| 1,371,468 | 3/1921 | Burges . | |
| 1,437,876 | 12/1922 | Tyler | 141/45 |
| 2,188,587 | 4/1940 | Skinner . | |
| 2,301,617 | 11/1942 | Cox et al. | 406/152 |
| 2,372,343 | 3/1945 | Smith . | |
| 2,574,848 | 5/1946 | Schroeder . | |
| 2,708,542 | 5/1955 | Gray et al. | 141/7 |
| 2,720,375 | 10/1955 | Carter | 141/68 X |
| 2,765,816 | 10/1956 | Carter | 141/65 |
| 3,165,774 | 1/1965 | Barba | 15/323 |
| 3,304,219 | 2/1967 | Nickerson . | |
| 3,396,762 | 8/1968 | Paton | 141/7 |
| 3,450,253 | 6/1969 | Nielsen . | |
| 3,527,413 | 9/1970 | Crowther . | |
| 3,580,644 | 5/1971 | Ballard | 406/171 X |
| 3,737,074 | 6/1973 | Davies | 406/171 |
| 3,876,260 | 4/1975 | Moss et al. | 141/65 X |
| 3,884,528 | 5/1975 | Shaddock | 406/171 X |
| 4,167,235 | 9/1979 | Green . | |
| 4,186,782 | 2/1980 | Scharf . | |
| 4,411,388 | 10/1983 | Muck . | |
| 4,541,765 | 9/1985 | Moore | 222/105 X |
| 4,643,776 | 2/1987 | Hollowell et al. . | |
| 4,799,830 | 1/1989 | Fuss . | |
| 4,834,586 | 5/1989 | Depew | 406/152 X |
| 4,934,875 | 6/1990 | Fuss . | |
| 4,945,956 | 8/1990 | Bueyuekguclue et al. . | |
| 4,946,291 | 8/1990 | Schnaars | 383/41 X |
| 4,947,903 | 8/1990 | Beckwith . | |
| 4,979,547 | 12/1990 | Hoerner | 141/390 |
| 5,033,492 | 7/1991 | Mertens et al. . | |
| 5,071,290 | 12/1991 | Johnson | 406/171 |

FOREIGN PATENT DOCUMENTS

| | | | |
|---|---|---|---|
| 0629178 | 4/1936 | Fed. Rep. of Germany | 141/93 |
| 1115636 | 10/1961 | Fed. Rep. of Germany | 383/22 |
| 3613394 | 10/1987 | Fed. Rep. of Germany | 141/93 |
| 1406647 | 6/1965 | France . | |

OTHER PUBLICATIONS

Author unknown, "Filling by Suction . . . An Improvised Method," Modern Packaging, Sep. 1944, pp. 116–117.

1991 U-Line Catalog Spring/Summer, U-Line, Inc., Lane Bluff, Ill., p. 88.

1991 Quickdraft Brochure, Canton, Ohio.

*Primary Examiner*—J. Casimer Jacyna

*Attorney, Agent, or Firm*—Pretty, Schroeder, Brueggemann & Clark

[57] ABSTRACT

An overhead vacuum assembly for recovering, storing and dispensing flowable packaging material including a flexible storage bag having an open upper end for receiving flowable packaging material, a dispensing valve mounted at the lower end of the bag, a liner or frame for maintaining the perimeter shape of the flexible bag, a cover mounted at the open upper end of the flexible bag, a fan motor assembly, including a filter, mounted to the cover for creating a vacuum in the bag and a hose mounted to the cover. The filter acts as a deflector to evenly distribute the loose fill throughout the bag during the recovery process. The cover may have a pyramidal shape and tear-away panels for ease of maintenance.

18 Claims, 4 Drawing Sheets

OVERHEAD VACUUM ASSEMBLY FOR RECOVERING, STORING AND DISPENSING FLOWABLE PACKAGING MATERIALS

This invention relates generally to an apparatus for recovering loose fill materials and, more particularly, for the recovery, storage and dispensing of flowable, packaging materials of the type used for protecting the contents of a container against damage.

BACKGROUND OF THE INVENTION

Flowable packaging materials are a form of dunnage which are now typically manufactured of expanded or extruded polystyrene or organic starch based product in various preselected shapes, such as a figure "8" or an "S" shape. The materials now in use are intended to provide readily flowable, light-weight dunnage of high volumetric efficiency and good strength in compression. The cost and ease of handling flowable packaging materials permit them to be used with great advantage over other types of packaging because an article to be protected within an outer container can very quickly be surrounded with an encompassing cushion of loose fill, at very low added cost and with virtually no, or very low, shipping penalty.

Large users of flowable packaging materials have their materials delivered by large trucks. The material is then blown through a mass delivery system. Individual users typically receive their materials in plastic bags of approximately 15 cubic feet or less capacity. Most typically, an overhead storage bag or hopper (or alternatively referred to herein as a dispenser bag) is then built above a dispensing location, and the bag or hopper feeds the loose fill by gravity down into the area of use. To fill the bag or hopper with material, the bag or hopper must be lowered to be filled or a ladder must be employed to load either small quantities (in the recycling case) or large quantities (in the case of preparations for dispensing for shipping purposes). Many large scale systems, (as further described herein) have been designed to solve loose fill handling for dispensing purposes. To date, however, there has been little attention paid to the small end user who also has material handling problems although on a smaller scale.

For large shippers who package with flowable material, a main concern is the efficient transport of a large volume of material from the storage location to the dispensing location. U.S. Pat. No. 4,799,830 to Fuss describes such a system wherein one or more air blowers are used to feed flowable material through large air plenums to a dispensing station over a hopper which collects spilled material for recycling. U.S. Pat. No. 4,167,235 to Green describes a similar system having a large storage bag that feeds a plurality of dispensing bags via an air conveying system. Neither of these systems, however, is particularly suitable for shippers or their customers who receive flowable packaging material with incoming packages and who must deal with the mess of emptying the incoming packages of their contents as well as the cushioning loose fill packaging material.

U.S. Pat. No. 4,947,903 to Beckwith describes a material recovery apparatus that purports to solve this latter problem. The apparatus includes an overhead bin for storing recovered loose fill material, a vacuum assembly including a container inside the bin having a hinged bottom door for initially receiving the vacuumed material, a suction hose for picking up the loose fill, and a linkage for maintaining the bottom door closed during vacuuming, but which releases the door when the vacuum is off permitting the recovered material in the container to fall into the bin below. Use of such an apparatus enables a user to clean up spilled material or to recover material from incoming boxes. The apparatus, however, has a number of disadvantages. It takes up a large amount of room and may be unsuitable for storage areas that do not have raised ceilings. Storage capacity of the bin is reduced in view of the necessity of the separate container within the bin and the use of the hinged door that takes up even further space in the bin. The apparatus is also unable to continuously fill an empty bin prior to starting a large dispensing operation. In other words, the bin must be loaded one containerfull at a time, taking many operations to fill the dispenser.

It should, therefore, be appreciated that there is still a need for a compact, quiet, light-weight and easily assembled and maintained loose fill recovery and dispensing assembly. Such a device should also maximize the storage capacity of the dispensing bag and be readily adaptable to either the recovering process or the dispensing process. The present invention satisfies this need.

SUMMARY OF THE INVENTION

The present invention is embodied in an overhead vacuum assembly that recovers, stores and dispenses flowable packaging material. The assembly is made primarily with light-weight materials, is easily constructed and maintained, and may be mounted in storage areas having little available overhead space while maximizing the storage capacity available for storing loose fill materials. A further advantage of the present invention is that it is easily retrofittable to many dispensing bags already in public use or may be readily adapted to different sized dispensing bags.

The assembly of the present invention includes a flexible storage bag having an upper end for receiving flowable packaging material and a lower end having an opening for dispensing flowable packaging material received in the bag, a dispensing valve mounted at the lower end of the bag, a liner or frame for maintaining the perimeter shape of the flexible bag, a cover mounted over the open upper end of the flexible bag, a fan motor and filter assembly mounted to the cover for creating a vacuum in the bag and a hose also mounted to the cover.

A feature of the invention is the use of a cover to seal the dispensing bag, providing a contained space for negative pressure. The cover also provides protection from settling dust as well as a barrier to insects and rodents. The cover also acts as a superstructure for hanging the dispenser bag and for mounting the hose inlet and fan motor and filter assembly, whereby they work synergistically to distribute the incoming material in a random, but calculated, pattern in the dispenser bag that allows the bag to be filled to maximum capacity without interruption. In the preferred embodiment, the cover has a pyramidal shape and tear-away panels for ease of maintenance.

Another feature of the present invention is the use of a form-fitting, light-weight liner, preferably made from corrugated cardboard for maintaining the shape of the storage bag. Such a liner prevents the bag from collapsing during the recovering process thus ensuring that the bag will be filled to capacity. The liner also improves the overall appearance of the assembly and has a dynamic effect on the assembly during operation to also help ensure that the bag may be filled to capacity.

An additional feature of the present invention is the use of a deflector mounted to the cover for deflecting the recovered flowable packaging material into the bag in a manner that will maximize capacity while insuring a non-interrupted process. In the preferred embodiment, the deflector includes a wedge-shaped portion that forms part of a filter for the fan motor and filter assembly. The deflector is located in opposition to the incoming stream of flowable packaging material to deflect the stream as desired.

The hose is specially designed at the inlet end to resist entry of materials other than the flowable packaging material, such as packing lists, invoices or the packaged material itself. The hose, for example, may be provided with an inlet cone having a larger diameter point of entry for allowing a gentle suction to evacuate boxes. Protrusions may also be placed in the cone to catch and retrieve, without turning the vacuum off, larger sized lighter material such as paper. The hose may also be provided with an adjustable hanger.

Other features and advantages of the present invention will become apparent from the following description of the preferred embodiment, taken in conjunction with the accompanying drawings, which illustrate, by way of example, the principles of the invention.

DESCRIPTION OF THE PREFERRED EMBODIMENT

Figure 1:
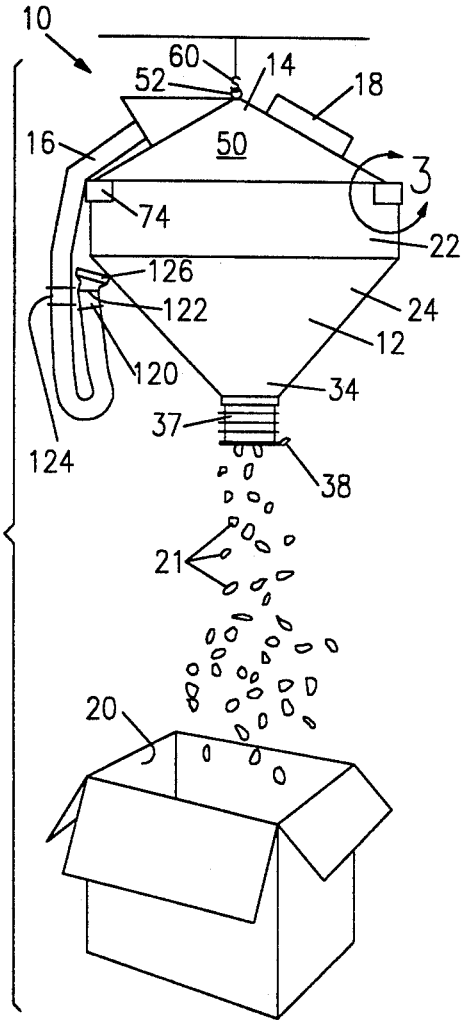
FIG. 1 is an elevational view of the overhead vacuum assembly of the present invention.
Figure 2:
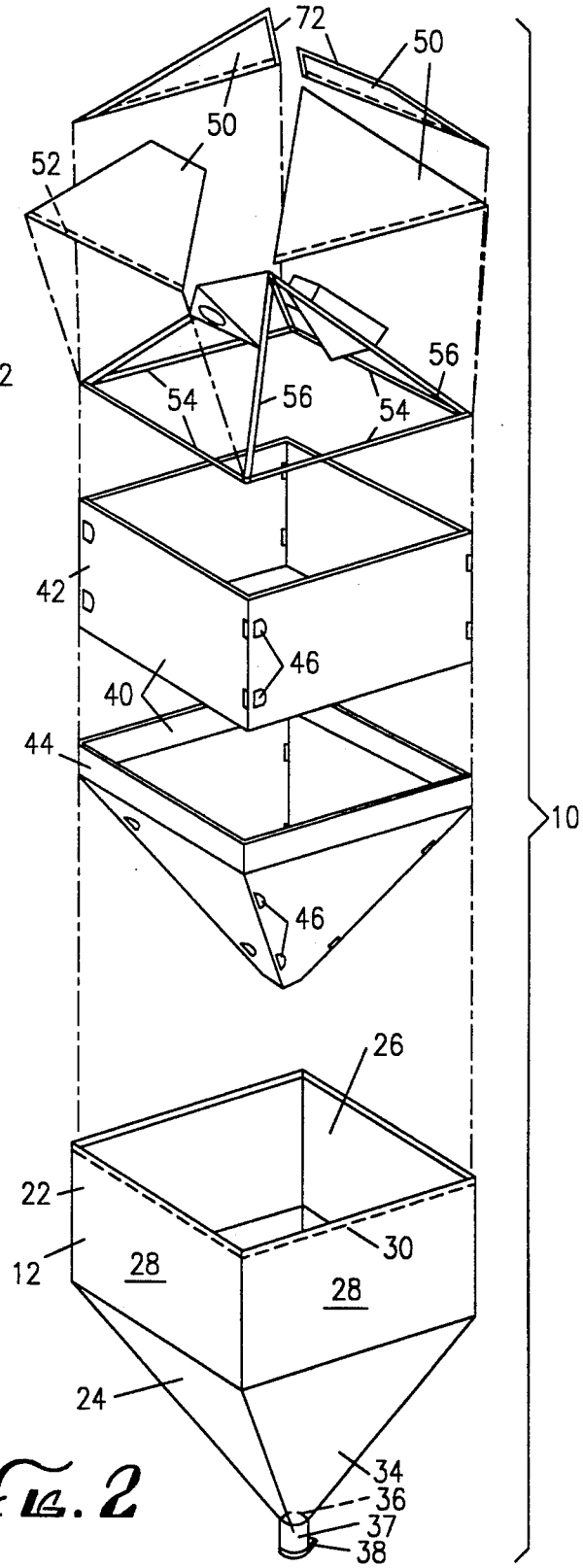
FIG. 2 is an exploded view of the preferred overhead vacuum assembly shown in FIG. 1.

An overhead vacuum assembly 10 embodying the features of the present invention is shown in FIGS. 1 and 2. The assembly includes a dispenser bag or storage bag 12, a cover 14, a suction hose 16 and a fan motor assembly 18. A container 20 is shown in FIG. 1 for receiving flowable packaging material 21.

The dispenser bag 12 is made of a rugged, lightweight, flexible material, such as a reinforced nylon or poly fabric or other suitable material that does not readily allow the passage of air therethrough. Typical dispenser bags presently in use have an upper rectangular portion 22 and a lower conical portion 24. However, other shapes may be used.

The rectangular portion has an open upper end 26 and four sidewalls 28. An upper end of each sidewall typically has a looped portion 30 for receiving a perimeter pipe 40 (see FIG. 5 also). The perimeter pipes of the four sidewalls are connected to each other to provide a structure for hanging the dispenser bag. Polyvinyl chloride piping, electrical metal tubing, wood dowels or other material of equivalent strength is suitable.

A lower end 34 of the conical portion 24 of the dispenser bag has an opening 36 for dispensing flowable packaging material. A dispensing hose 37 having a scissor valve 38 or other suitable device for selectively dispensing material is mounted over the opening 36. The dispensing hose is preferably flexible to improve mobility and is made of a clear plastic to permit viewing of material flow during the dispensing operation.

To prevent the dispenser bag from collapsing during the vacuuming operation, an inner frame is provided to maintain the bag's perimeter shape. With reference to FIG. 2, a preferred frame is shown in the form of a form-fitting liner 40. The liner includes a sleeve portion 42 and a cone portion 44 and is preferably made from a lightweight, rigid, sheet-like material, such as corrugated cardboard, plastic or other rigid material that will not collapse during the vacuuming operation. The liner or portions thereof may be made from a single unitary piece, or the sleeve and cone portions may each be constructed from four die-cut panels that are fitted together by a slot and tab arrangement 46. The panels are interlocked to improve the strength of the liner, enabling it to better hold the shape of the dispenser bag. After the liner is assembled, it is inserted into the dispenser bag.

Alternatively, an inner frame for the dispenser bag may be constructed of piping or tubing to maintain the bag's perimeter shape. Another alternative is U-shaped bag expander rings, i.e., resilient pieces of flat metal bent in a U-shape, that are inserted into the bag from corner to corner to help maintain the bag shape. A form-fitting liner, however, is preferable in order to maximize the storage capacity of the bag and to improve the appearance of the assembly. Vertically-oriented slots (not shown) may be provided in the liner to allow viewing of the level of material in the dispenser. The liner also has added benefit during the vacuuming operation which will be explained in more detail below.

Figure 3:
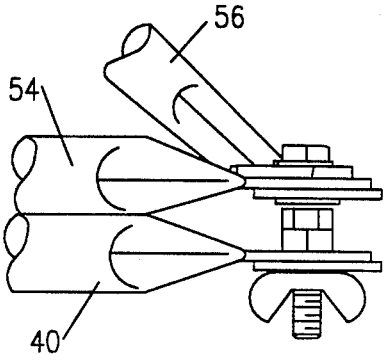
FIG. 3 is an enlarged sectional view of the circled area 3 in FIG. 1.

The cover 14 is mounted over the open upper end 26 of the dispenser bag. The cover provides a near airtight seal sufficient to provide a contained space to build negative pressure for drawing flowable packaging material through the suction hose. The cover may simply be a flat sheet of material, such as plywood, placed over the open end of the dispenser bag. Preferably, however, the cover has a pyramidal or conical shape including one or more upwardly extending wall panels 50. The lower end of each wall panel may be provided with a looped portion 52 for receiving a perimeter pipe 54 (see also FIG. 5). The perimeter pipes 54 of the cover may then be mounted on the perimeter pipes 40 at the upper end of the dispenser bag to seal the assembly. As shown in FIG. 3, the perimeter pipes of the cover and bag may be flattened at their ends and fastened in a match overlay pattern, which allows a good seal between the pyramidal top and the dispenser bag.

The upwardly extending wall panels 50 are further supported by corner pipes 56 that are located in each corner between adjacent wall panels. The corner pipes may be fastened at their bottom ends to the perimeter pipes of the cover and bag in the match overlay pattern shown in FIG. 3. Cushioned corner flaps 74 may be provided to cover the connection (see FIG. 1). The corner pipes 56 are also fastened together at their top ends in a similar match overlay pattern. A fastener 52 at the top of the cover may have an S-hook 60 for mounting the assembly to an overhead support or to such rope and pulley systems as known to those skilled in the art.

The wall panels may be made of the same material as the dispenser bag, a reinforced nylon or poly fabric. A hook and loop type fastener 72 may be used to fasten the panels to each other or to the corner pipes 56. This permits ready removal of selected individual panels, allowing inspection and maintenance inside the assembly (see FIG. 4).

Figure 4:
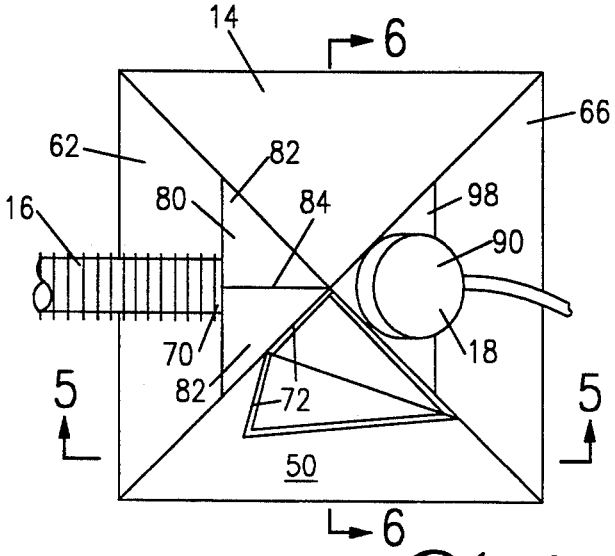
FIG. 4 is a plan view of the overhead vacuum assembly shown in FIG. 1, showing one wall panel partially removed.
Figure 5:
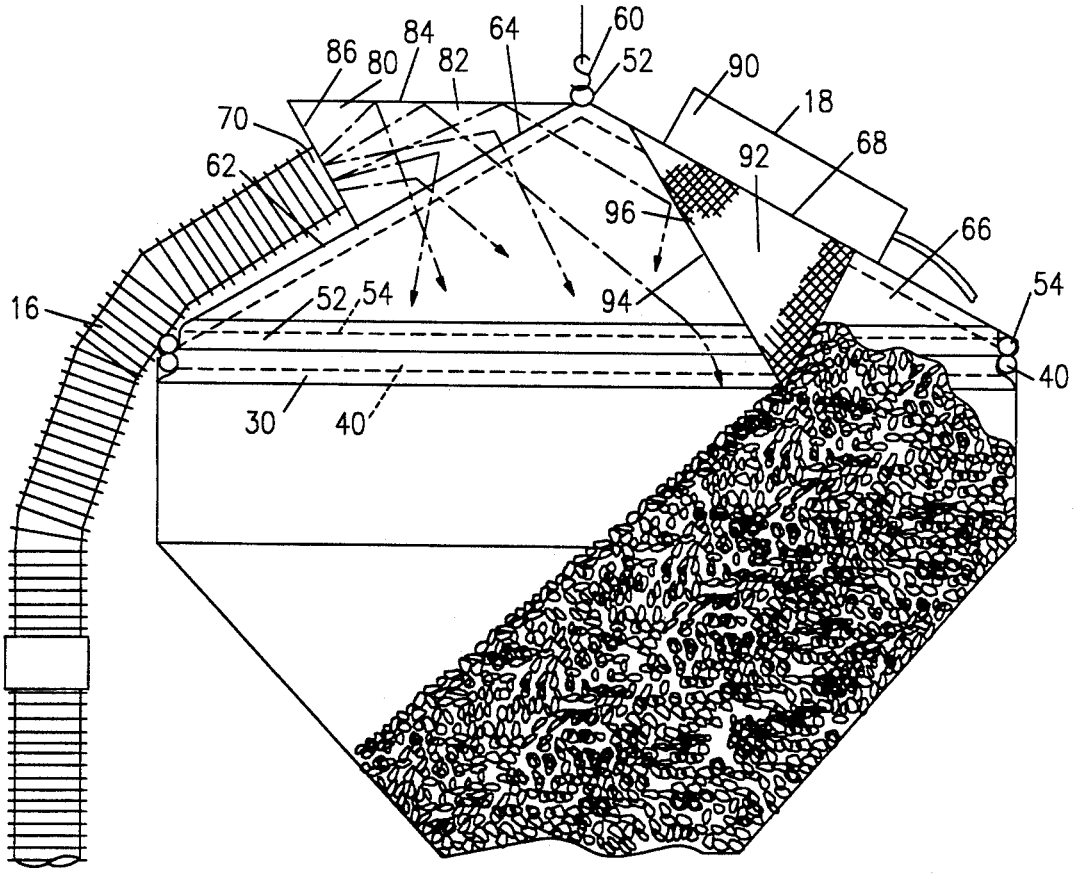
FIG. 5 is a sectional view of the overhead vacuum assembly taken along line 5—5 of FIG. 4.

With reference to FIGS. 4 and 5, a first wall panel 62 of the cover has an opening 64 for receiving material exiting an exit end 70 of the suction hose 16. A second wall panel 66, preferably opposite the first wall panel 62, has an opening 68 for receiving the fan motor assembly 18. The exit end 70 of the suction hose is received in a housing 80 mounted over the opening 64 the first wall panel 62. In the preferred embodiment, the housing is shaped like a dormer having two upwardly extending walls 82 that converge to form a peak 84. The housing also includes a front wall 86 having an inlet for receiving the exit end of the hose. The hose may be fastened to the front wall of the housing in such a manner as to direct a stream of flowable packaging material into the converging walls 82, thus dissipating some of the energy in the stream prior to its entering the interior of the assembly. The housing may be made of sheet metal plastic, or other semi-rigid material and mounted to the corner pipes. Alternatively, the shape of the housing may be a dome or conically configured.

The fan motor assembly 18 includes a fan motor 90 and a fan motor mount 98. A suitable fan motor for the present invention is a squirrel cage fan motor, which has an exceptionally quiet operation. The fan motor mount may be made of sheet metal, plastic or other suitable material and mounted to the corner pipes. The fan motor also includes a filter 92 over its suction end to prevent the passage of material into the fan motor that may cause it damage. The filter may simply be a metal screen material that does not inhibit air flow, but which blocks the entry of loose fill material. A secondary filter, such as a fabric or fiberglass screen material, may be placed between the fan motor inlet and the screen filter to block even smaller particles from entering the fan motor.

In the preferred embodiment, the screen filter 92 is also used as a deflector to split or divert the stream of flowable packaging material entering the assembly. In particular, flowable packaging material has an angle of repose of approximately 40°. This means that unless forced to do otherwise, the material will pile up in a conical fashion at an angle of 40° conforming to the confines of the container in which it is deposited. This becomes a problem when the top of the cone of material reaches the opening 64 in the cover where the stream of flowable material enters the container. At this point, the conical pile of material blocks the opening and the flow of further material. The perimeter of the container then becomes wasted space, thus limiting the capacity of the container to something less than its true capacity.

Figure 6:
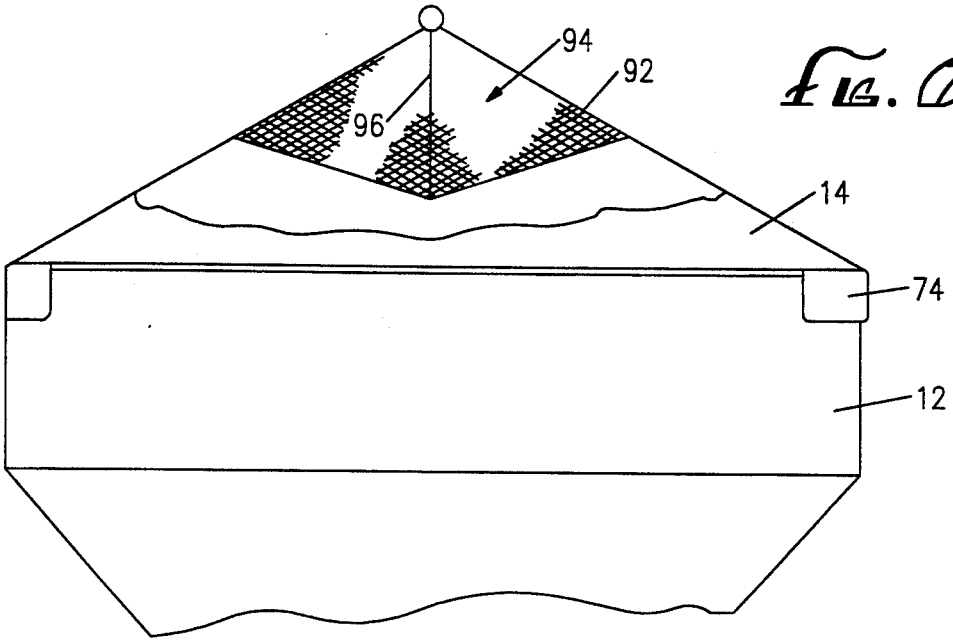
FIG. 6 is a sectional view of the overhead vacuum assembly taken from line 6—6 in FIG. 4.

The filter/deflector 92 of the present invention is used to obtain an improved distribution of loose fill in the dispenser bag as it is being filled. With reference to FIGS. 5 and 6, the filter/deflector is shown having a wedge portion 94 placed in the stream of the flowable packaging material emerging from the housing 80. The wedge portion has a downwardly extending peak 96 that splits the stream into two paths, diverting the flowable packaging material to the rear and sides of the dispenser bag. As shown in FIG. 5, the side of the bag opposite the housing inlet preferably fills up first with flowable material. As the bag fills, the last portion of the bag to be filled is immediately adjacent the housing inlet. The filter/deflector thus maximizes dispenser bag capacity.

Figure 7:
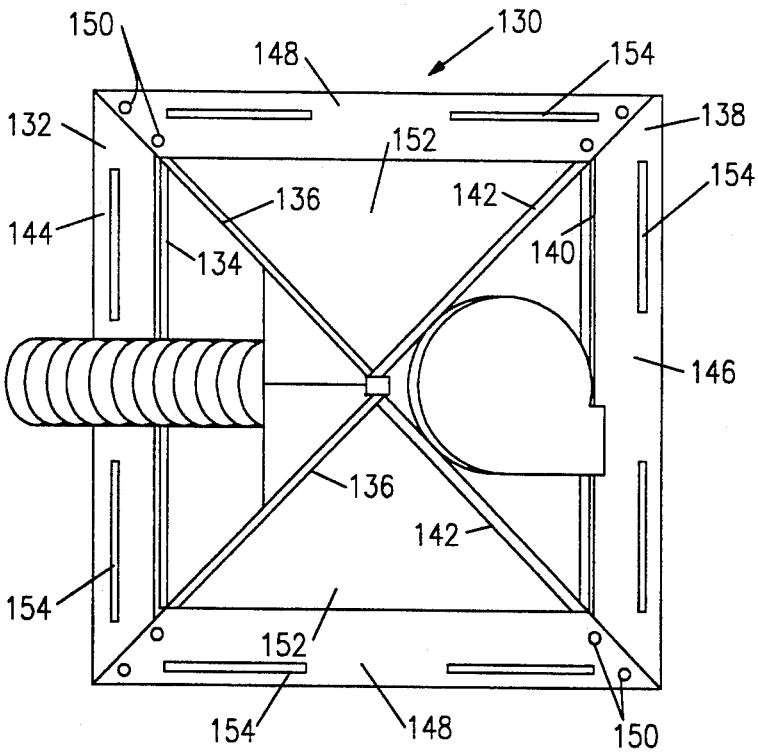
FIG. 7 is a plan view of a first modified overhead vacuum assembly made in accordance with the present invention.

With reference to FIG. 7, an alternative construction for a cover 130 for the overhead vacuum assembly is shown that is particularly useful for retrofitting. In this case, a first wall panel 132 for receiving the housing for the hose is made of a rigid material such as sheet metal or plastic. The first wall panel has a reinforcement rib 134 to provide strength and a flange 136 along each side of the wall panel. A second wall panel 138 for receiving the fan motor assembly is similarly made of a rigid material such as sheet metal or plastic and also has a reinforcement rib 140 and flanges 142. The first wall panel has a lower portion 144 below the reinforcing rib 134 and the second wall panel has a lower portion 146 below the reinforcing rib 140. Fastened between these lower portions of the first and second wall panels are rigid connecting strips 148. Perimeter fasteners 150 may be used to fasten the ends of the connecting strips to the flanges on the first and second wall panels. Above each connecting strip is an opening 152 that provides access into the assembly. Fabric wall panels (not shown), similar to the fabric wall panels 50 used for the cover in FIG. 1, may be fastened by hook and loop type fasteners over the openings 152.

In order to mount the dispenser bag to the cover, the lower portions 144, 146 of the first and second wall panels and each of the connecting strips 148 are provided with slots 154 for receiving the looped portions at the upper end of a standard dispenser bag. If necessary, the looped portions are cut to about the same length as the length of the slots to permit the looped portions to be passed up through the slots. The dispenser bag is then secured to the cover by stringing a rope or a cable (not shown) through the looped portions extending up through the slots. It will be appreciated that in this embodiment, the perimeter and corner pipes of the dispenser bag and cover shown in FIGS. 2 and 3 are unnecessary, as the panelized construction provides the strength for the structure.

Figure 8:
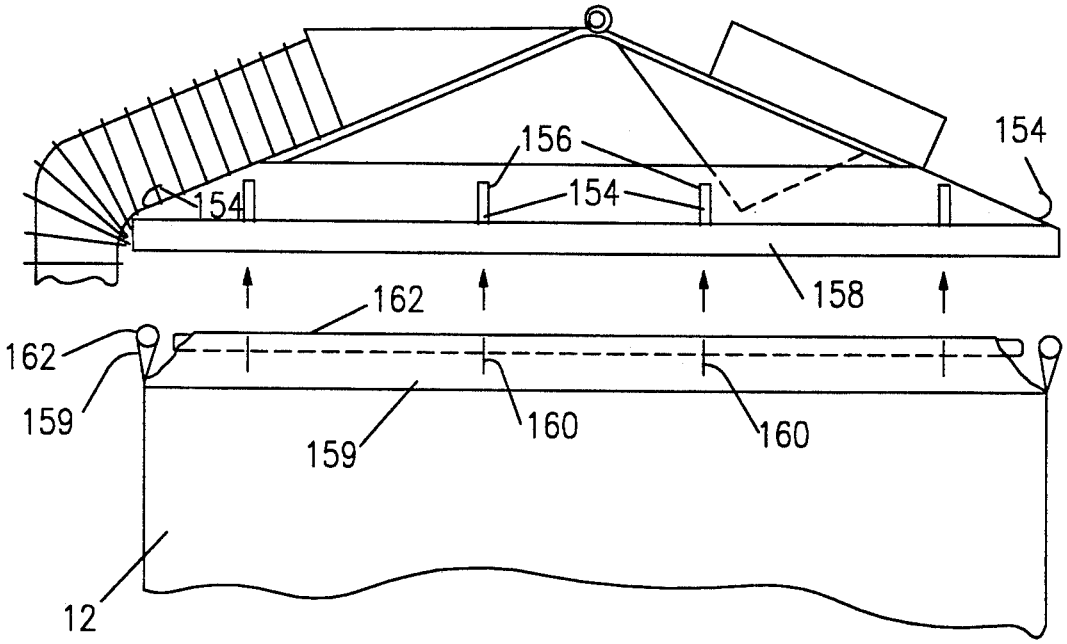
FIG. 8 is an elevational view of a second modified overhead vacuum assembly made in accordance with the present invention wherein the dispenser bag is shown unattached to the cover.

With reference to FIG. 8, a further embodiment of the overhead vacuum assembly is shown wherein the slots 154 shown in the cover of FIG. 7 are replaced by hanger hooks 154. The hanger hooks may be mounted in notches 156 in the lower portions of the first and second wall panels and in the connecting strips. In this embodiment, the cover is also provided with a vertically-extending skirt 158. In order to mount the dispenser bag to the cover, the looped portions 159 of the dispenser bag 12 are provided with slits 160 that are aligned with the hanger hooks. The dispenser bag is then pulled up over the skirt of the cover, the hanger hooks are slid through the slits in the looped portions, and the perimeter pipes or wood dowels 162 are then rested upon the hanger hooks. The ends of the looped portions may be bevel cut to conform to the pyramid cover. The looped portions hang over the edge of the cover adjacent the skirt which thus provides a near airtight seal.

Figure 9:
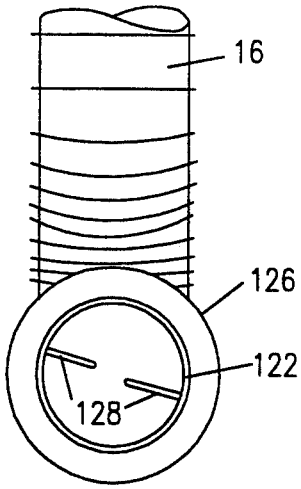
FIG. 9 is an end view of the inlet end of a hose that may be used with the present invention.

The suction hose 16 is preferably made of wire reinforced polyvinyl chloride. This material is clear, permitting a user to view the flow of loose fill through the hose. Such a material is also very flexible and will bend 180° in not much more than twice its diameter. These characteristics make the hose easy to work with when evacuating boxes of packaging material. This also makes the hose easy to hang. For example, an adjustable hanger may be provided with a pair of fastening bands, one band comprised of hook material 120 secured to an inlet end 122 of the hose and a second band 124 comprised of looped material secured to the hose closer to the dispenser bag at any desired height (see FIG. 1). The inlet end 122 of the suction hose may also be provided with an inlet cone 126 having a larger diameter at the point of entry. This configuration reduces the suction at the point of entry, allowing a gentle suction for evacuating boxes. This leaves desirable product in the container undisturbed. With reference to FIG. 9, the inlet end of the hose is also shown having two protrusions 128 extending inwardly from the circumference of the hose. The protrusions resist the entry of pieces of paper such as packing lists or invoices that may be present with the loose fill material. The protrusions catch such material, allowing for easy retrieval without the need to turn the fan motor off.

To recover flowable packaging material from incoming boxes, the fan motor 90 is energized and the inlet end 122 of the hose 16 is hovered over the material to be recovered. In the case of filling the dispenser bag 12 with virgin material from a large storage bag, the inlet end of the hose may be plunged into the material in the storage bag. In either case, the recovered material will accelerate rapidly through the inlet cone of the hose up to the exit end 70 of the hose at the housing 80 (see FIG. 5). The stream of flowable packaging material will then strike the converging walls 82 of the housing causing some of the flowable material to drop into the dispenser bag and another portion of flowable material to deflect toward the filter/deflector 92 of the fan motor assembly. The portion of flowable material deflected toward the filter/deflector will then split and move towards the periphery of the dispenser bag to completely fill the bag. It has been found that causing the stream of flowable packaging material to strike the converging walls or dome of the housing improves the flow characteristics of the material into the assembly and helps prevent the filter from being unduly blocked by the loose fill material.

One notable advantage of using the cardboard liner 40 referred to earlier (see FIG. 2), is that when the fan motor is turned on, the liner will rise slightly due to the suction created in the assembly and will remain slightly raised until the dispenser bag is filled to the top at which time the flowable packaging material blocks the passage of further material from the hose. At this point, the fan motor is turned off causing the liner to drop, as much as a few inches, settling the contents of the bag and freeing up additional space at the top of the dispenser bag to empty out the remaining flowable packaging material left in the hose and/or to clean up the recovery area. The dispenser bag may be manually agitated to cause additional settling.

Should some of the packaged material itself be accidently drawn up into the dispenser bag or should the motor or filter require service, the assembly may be lowered to the floor and one or more of the tearaway wall panels may be removed to provide easy access into the assembly.

It should be appreciated from the foregoing description that the present invention provides an overhead vacuum assembly that substantially fills a standard dispenser bag in one continuous operation. The assembly may also be adapted to permit a second cycle to clean up the work area after the bag is substantially full. The assembly is economical, lightweight, compact, quiet and easy to assemble.

It will, of course, be understood that modifications to the presently preferred embodiment will be apparent to those skilled in the art. Consequently, the scope of the present invention should not be limited by the particular embodiments discussed above, but should be defined only by the claims set forth below and equivalents thereof.

I claim:

1. An overhead vacuum assembly for recovering, storing and dispensing flowable packaging material, comprising:

a flexible storage bag having an open upper end for receiving flowable packaging material and a lower end having an opening for dispensing flowable packaging material received in the bag;

a dispensing valve mounted at the lower end of the bag for selectively opening and closing the opening at the lower end of the bag;

a rigid frame disposed along the entire periphery of the bag and configured to maintain the perimeter shape of the flexible bag both prior to and during dispensing to prevent it from collapsing when a vacuum exists inside the bag relative to the outside surface of the bag;

a cover mounted over the open upper end of the flexible bag and providing a near airtight seal that permits the creation of a vacuum inside the bag relative to the outside surface of the bag for drawing a stream of flowable packaging material into the bag when the dispensing valve is closed, the cover defining a first opening and a second opening;

a fan motor assembly mounted over the first opening of the cover, the fan motor assembly having a fan motor for creating said vacuum inside the bag relative to the outside surface of the bag for drawing the stream of flowable packaging material into the bag; and a hose having an entry end and an exit end, the exit end mounted over the second opening of the cover.

2. The overhead vacuum assembly of claim 1, wherein said fan motor assembly includes a filter for the fan motor, said filter located in the stream of flowable packaging material entering the bag during operation of the fan motor for deflecting the flowable packaging material towards the perimeter of the bag.

3. The overhead vacuum assembly of claim 1, wherein said fan motor assembly includes a filter for the fan motor, said filter located in the stream of flowable packaging material entering the bag during operation of the fan motor for deflecting the flowable packaging material in a random, but calculated, pattern throughout the bag.

4. An overhead vacuum assembly for recovering, storing and dispensing flowable packaging material, comprising:

a flexible storage bag having an open upper end for receiving flowable packaging material and a lower end having an opening for dispensing flowable packaging material received in the bag;

a dispensing valve mounted at the lower end of the bag for selectively opening and closing the opening at the lower end of the bag;

a rigid frame disposed along the entire periphery of the bag and configured to maintain the perimeter shape of the flexible bag both prior to and during dispensing to prevent it from collapsing when a vacuum exists inside the bag relative to the outside surface of the bag;

a cover mounted over the open upper end of the flexible bag and providing a near airtight seal that permits the creation of a vacuum inside the bag relative to the outside surface of the bag for drawing a stream of flowable packaging material into the bag when the dispensing valve is closed, the cover having an upwardly extending wall defining a first opening and a second opening;

a fan motor assembly mounted over the first opening of the cover, the fan motor assembly having a fan motor for creating said vacuum inside the bag relative to the outside surface of the bag for drawing the stream of flowable packaging material into the bag; and a hose having an entry end and an exit end, the exit end mounted over the second opening.

5. The overhead vacuum assembly of claim 4, wherein said means for maintaining the perimeter shape of the flexible bag includes a form-fitting liner of sheetlike material disposed around the inner perimeter of the bag.

6. The overhead vacuum assembly of claim 5, wherein said form-fitting liner is made from a corrugated paper product.

7. The overhead vacuum assembly of claim 5, wherein said storage bag includes a cone portion at the lower end of the bag and said form fitting liner extends down to maintain the perimeter shape of the cone portion.

8. The overhead vacuum assembly of claim 4, wherein said cover has a pyramidal shape and said upwardly extending wall includes a first wall portion that defines the first opening and a second wall portion that defines the second opening.

9. The overhead vacuum assembly of claim 8, wherein said upwardly extending wall includes a third wall portion, one of said wall portions being readily detachable to provide access to the interior of the cover.

10. The overhead vacuum assembly of claim 4, further comprising a deflector located in the stream of the flowable packaging material entering the bag during operation of the fan motor for deflecting the flowable packaging material towards the perimeter of the bag.

11. The overhead vacuum assembly of claim 10, wherein said fan motor has a suction end and said deflector is a filter mounted over the suction end to prevent flowable packaging material from entering the fan motor assembly.

12. The overhead vacuum assembly of claim 11, wherein said deflector is mounted to the cover and forms a wedge in the stream of flowable packaging material to split the stream into two paths.

13. The overhead vacuum assembly of claim 11, further comprising a housing mounted over the second opening of the cover, the housing having an inlet and an interior surface, the hose mounted to the housing inlet such that the stream of flowable packaging material emerging from the hose during operation of the fan motor is deflected by the interior surface of the housing into the bag.

14. The overhead vacuum assembly of claim 4, wherein the entry end of the hose has a plurality of protrusions extending inwardly from the circumference of the hose for blocking the passage of light material that is larger than said flowable packaging material.

15. The overhead vacuum assembly of claim 4, wherein the entry end of the hose is enlarged, for the purpose of reducing the vacuum at the point of contact of the material to be vacuumed.

16. An overhead vacuum assembly for recovering, storing and dispensing flowable packaging material, comprising:

a rigid container of sheetlike material having an open upper end for receiving flowable packaging material and a lower end having an opening for dispensing flowable packaging material received in the container;

a dispensing valve mounted at the lower end of the container for selectively opening and closing the opening at the lower end of the container;

a cover mounted over the open upper end of the container and providing a near airtight seal that permits the creation of a vacuum in the container for drawing a stream of flowable packaging material into the container when the dispensing valve is closed, the cover having an upwardly extending wall defining a first opening and a second opening;

a fan motor assembly mounted over the first opening of the cover, the fan motor assembly having a fan motor for creating said vacuum for drawing the stream of flowable packaging material into the container;

a hose having an entry end and an exit end, the exit end mounted over the second opening;

wherein said fan motor has a suction end and a filter mounted over the suction end to prevent flowable packaging material from entering the fan motor assembly, said filter further located in the stream of flowable packaging material entering the container during operation of the fan motor for deflecting the flowable packaging material towards the perimeter of the container; and a housing mounted over the second opening of the cover, the housing having an inlet and an interior surface, the hose mounted to the housing inlet such that the stream of flowable packaging material emerging from the hose during operation of the fan motor is deflected by the interior surface of the housing into the container.

17. The overhead vacuum assembly of claim 16, wherein said container is made from a corrugated paper product.

18. An overhead vacuum assembly for recovering, storing and dispensing flowable packaging material, comprising:

a flexible storage bag including an upper tubular portion and a lower conical portion, the tubular portion having an open upper end for receiving flowable packaging material and the conical portion having an opening at its lower end for dispensing flowable packaging material received in the bag;

a dispensing valve mounted at the lower end of the bag for selectively opening and closing the opening at the lower end of the bag;

a form-fitting liner of sheetlike material disposed around the inner perimeter of the bag for maintaining the perimeter shape of the tubular portion and the conical portion of the flexible bag;

a pyramidally-shaped cover mounted over the open upper end of the flexible bag and providing a near airtight seal that permits the creation of a vacuum in the bag for drawing a stream of flowable packaging material into the bag when the dispensing valve is closed, the cover having an upwardly extending wall defining a first opening and a second opening;

a fan motor assembly mounted over the first opening of the cover, the fan motor assembly having a fan motor for creating said vacuum for drawing the stream of flowable packaging material into the bag;

a housing mounted over the second opening of the cover, the housing having an inlet and an interior surface;

a hose having an entry end and an exit end, the exit end mounted to the housing inlet such that the stream of flowable packaging material emerging from the hose during operation of the fan motor is deflected by the interior surface of the housing into the bag; and a filter for the fan motor that also acts as a deflector located in the stream of the flowable packaging material entering the bag during operation of the fan motor for deflecting the flowable packaging material towards the perimeter of the bag.

* * * * *